United States Patent [19]

Marrero

[11] 4,103,125

[45] Jul. 25, 1978

[54] MODULAR ELECTRICAL SWITCH/OUTLET ASSEMBLY

[76] Inventor: Louis Marrero, 1209 Via Ramon, Escondido, Calif. 92025

[21] Appl. No.: 788,514

[22] Filed: Apr. 15, 1977

[51] Int. Cl.[2] ..... H01R 13/70

[52] U.S. Cl. ..... 200/51 R

[58] Field of Search ..... 200/51 R, 51.02; 174/53, 55

[56] References Cited

U.S. PATENT DOCUMENTS

| | | | |
|---|---|---|---|
| 1,938,309 | 12/1933 | Williams | 174/58 X |
| 2,160,713 | 5/1939 | Bentley | 174/53 |
| 2,410,287 | 10/1946 | Jaberg | 174/53 |
| 2,828,394 | 3/1958 | Mayzik | 174/59 UX |
| 2,843,652 | 7/1958 | Manzella | 174/58 |
| 3,953,689 | 4/1976 | Marrero | 200/51 R |

*Primary Examiner*—Donald F. Norton

*Attorney, Agent, or Firm*—Ralph S. Branscomb

[57] ABSTRACT

A multi-mode electrical switch-outlet assembly as characterized by separate switch and outlet receptacle modules which are selectively plugged into a wiring box in the selected one of numerous possible combinations, there being a special face plate designed to snap-lock onto these modules, sandwiching them between the face plate and the wiring box, the latter of which is adjustably retained in a special mounting bracket which ordinarily would be connected to a building stud behind the wallboard.

12 Claims, 15 Drawing Figures

MODULAR ELECTRICAL SWITCH/OUTLET ASSEMBLY

BACKGROUND OF THE INVENTION

Conventional installation of a switch or an outlet requires the provision of whatever switch, outlet, or switch-outlet combination, is necessary for the particular outlet site desired. The assembly is then nailed on a stud in ordinary practice such that it extends forward of the stud approximately the distance which would be occupied by the wallboard.

The wires are then pulled through a hole, or knockout, inside the box. The stripped conductors are then partially connected, with provisions made for the subsequent switch or receptacle to be installed. The partially completed connections are then stuffed (at least 6 inches per conductor) back into the wiring box to await wallboard installation.

The wallboard craftsman brings the large sheets of material up against the studs to be covered. The location(s) of the cutout(s) for the switch or outlet box(es) are then measured, estimated, and marked. The wallboard holes are then cut at the approximate locations marked. Now the wallboard is ready to be nailed onto the studs so that the wiring box(es) are accessible through the openings.

After the wallboard installation is finished, the electrician now must return to complete the job. The wires are now pulled back out of the wiring box, connections are then made to the switch or outlet device, and the wires are again crammed back inside the box while the device is screwed on the box. The final step is the installation of the screwed-on face plate.

SUMMARY OF THE INVENTION

The present assembly is the culmination of years of experience and designing outlets and represents a combination of elements which produce maximum versatility coupled with low per unit costs, minimum space occupation and a high level of safety built into the design.

The core of the unit is a wiring box into which power and return wires are inserted from the rear, the front face defining sockets for the insertion of the prongs of outlet receptacle modules or switch modules or combinations thereof. A face plate is provided which positively engages and snap-locks unto the front face of these modules, which ordinarily would be done at the point of manfacture, and the face plate is fastened by means of a single screw to the wiring box. The entire structure as thus described is adjustably mounted in a backet which is simply fastened to a building stud or the like.

The switch module is operated by means of a toggle or cam and in the illustrated embodiment two switches can be used, either to operate jointly to create a high current switch or a two way switch, or split apart and operated separately. A switch can be used in conjunction with a receptacle, or two receptacles can be used, or either switch or receptacle used by itself and the other aperture of the face plate covered with a cap.

Other advantageous features which cause the invention to represent the ultimate in outlet sophistication will become evident from the detailed description below.

DETAILED DESCRIPTION OF THE PREFERRED EMBODIMENT

The best overall illustration of the invention is that depected in FIG. 1, and parts illustarated therein will be described in broad terms prior to a detailed description.

Figure 1:
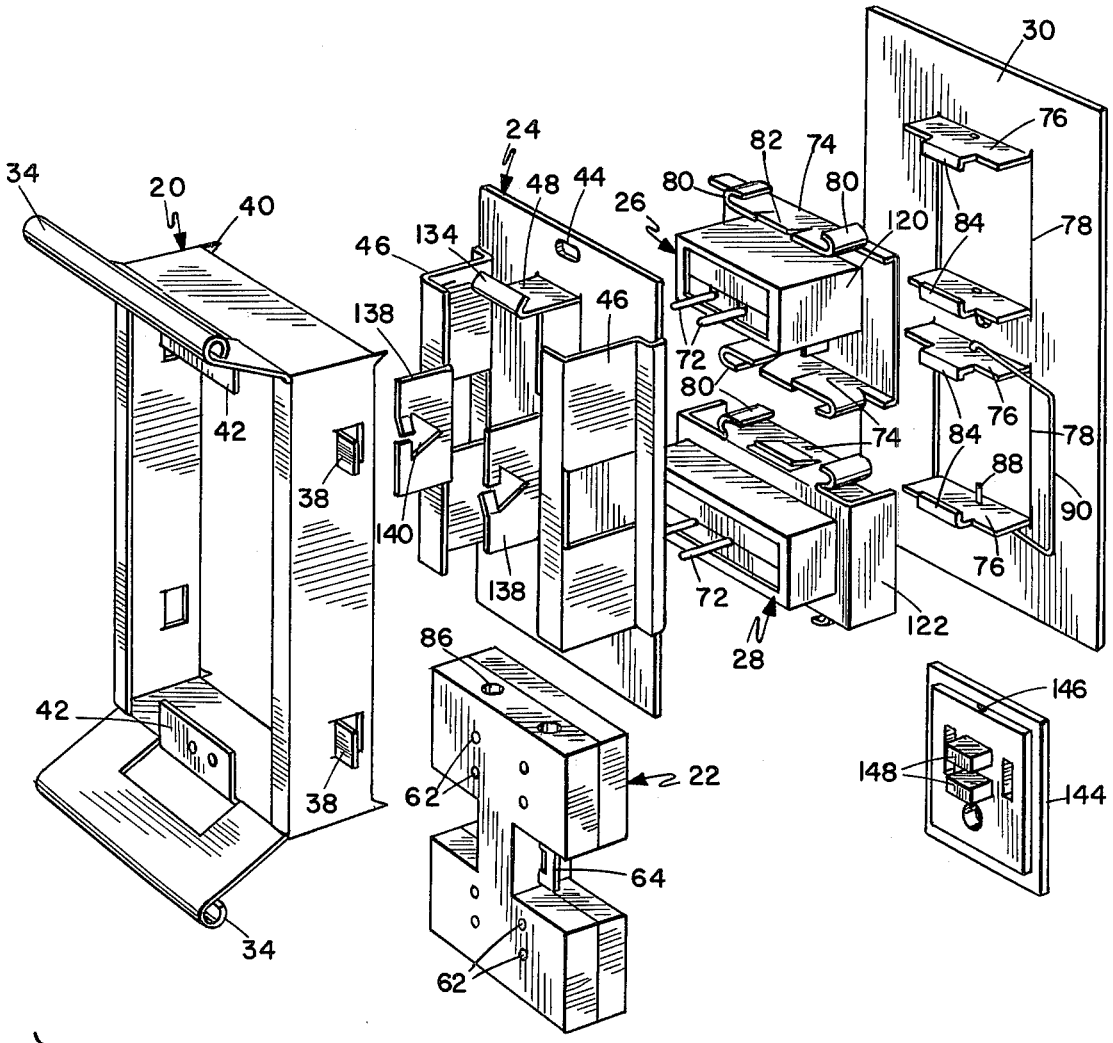
FIG. 1 is an exploded perspective view of the modular components.

The three elements on the left in FIG. 1 represent a mounting bracket 20, a junction cartridge 22 and a junction cartridge clip 24 above the junction cartridge. As the unit is received by the on-site electrician, the junction cartridge is inserted up into the junction cartridge clip 24, and the latter is fastened in the mounting bracket as will be described. Also, the desired switch or outlet combination is received pre-assembled on the face plate, ready to be plugged into the wiring box.

The junction cartridge makes all the electrical connections and the forward face is provided with two contact pairs or sockets to receive selectively a receptacle module 26 or a switch module 28. A face plate 30 will be clipped onto a particular combination of switch or receptacle modules in pre-assembled condition, and the face plate, together with the modules, is plugged into the wiring box and fastened down with a screw on site. Thus at the construction site the workman has only two component parts to connect.

Figure 3:
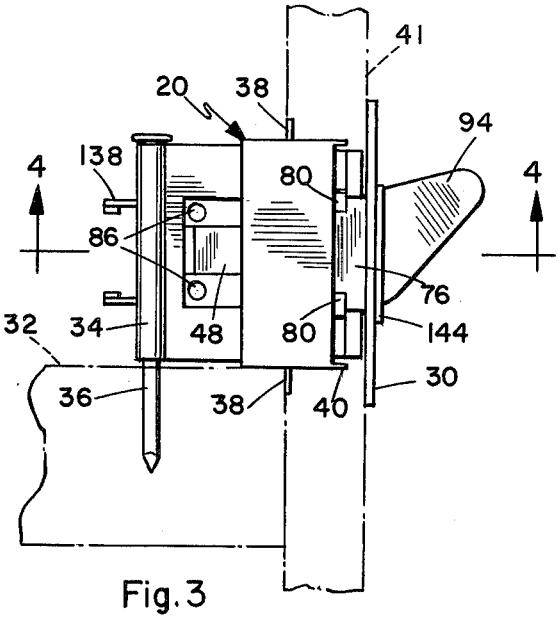
FIG. 3 is a top plan view of the assembled unit.

The detailed construction of the assembly is as follows. Turning first to the mounting bracket 20, this member is ordinarily mounted on a typical vertical building stud as is best shown in FIG. 3, the stud 32 being shown in phantom. Mounting flanges are rolled at 34 to receive nails 36 so that the entire bracket is simply mounted to the stud with a hammer. Tabs 38 are provided to properly align the bracket against the forward face of the stud, and score markers 40 projecting from the four forward corners of the bracket enable four points to be pressed into the rear face of wallboard, shown mounted at 41 in FIG. 3, so that the wallboard can be laid out and sawed accurately prior to final installation. A pair of inwardly struck mounting tabs 42 are used to mount the wiring box.

The wiring box is composed of the junction cartridge 22 and the junction cartridge clip 24 which receives the cartridge itself. The wiring box is made of these two components for manufacturing ease only. The cartridge clip has elongated holes 44 through which the wiring box is connected to the mounting tabs 42 of the brackets 20. Because these holes 44 are elongated, and because a couple of holes may be provided in the tab 42, the top and bottom of the wiring box may be independently adjusted laterally to achieve a twisting adjustment or a displacement adjustment or a combination if such is necessary. Forward or back tilting adjustment may be made by the screws penetrating the holes 44 as will become clear when the method of connection of the modules is explained.

The cartridge clip 24 includes a pair of side track-forming members 46 which slidably receive the junction cartridge and an end stop 48. Ordinarily at the point of manufacture the junction cartridge would be inserted into the cartridge clip to complete the wiring box, which would be connected loosely by screws 49 (seen in FIG. 4) to the mounting bracket 20 and presented as one complete sub-assembly.

Figure 6:
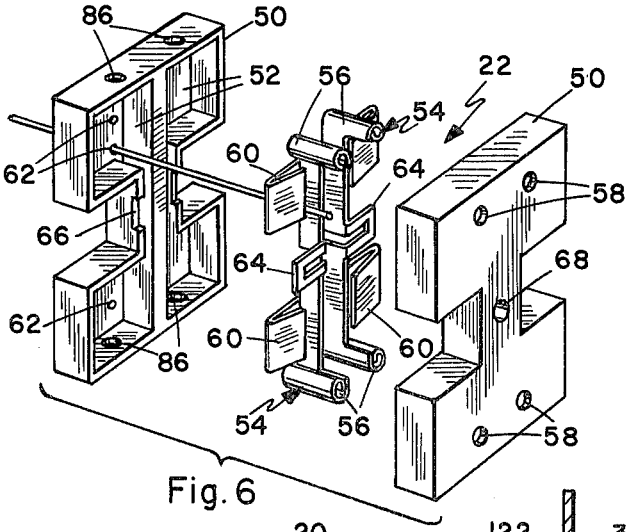
FIG. 6 is an exploded perspective view of the connector block.

Turning from FIG. 1 for a moment to FIG. 6 to describe the junction cartridge 22, same constitutes a pair of mating halves 50 which define internal cavities 52 which in turn provide snug seats for two junction elements 54. These elements make contact with incoming power and return wires and also provide receptacles for the prongs of the modules, described hereafter.

Each junction element is bent from a single metal stamping and rolled at the ends to define tunnel contacts 56 which receive through holes 58 in the front half 50 of the junction cartridge prongs from the various modules. Power wires are engaged by the side clips 60 so that no screws are needed, the wires being bared of insulation and inserted through rear holes 62 which align with holes in the side clips so that the spring panels thereof retain the wire ends as shown.

The junction elements as shown in FIG. 6 of course couple the upper and lower contacts of each contact pair so that they cannot act independently. This would be appropriate for example for use with a double outlet or a double current switch. In order to separate the upper and lower contact pairs for independent functioning, side portions 64 extend from the elements through notches 66 into bays formed in the cartridge. By reaching through the openings in the track forming members 46 (see FIG. 1) with a pair of needle nose pliers, these members 64 can be twisted apart and broken prior to installation to isolate the top and bottom.

The two halves 50 of the cartridge are kept together by the cartridge clip and do not require additional fastening means. The front half has an unthreaded central hole 68 to make room for the end of a mounting screw 70 which connects the face plate 30 to the cartridge clip 24. This screw also acts as the ground connection between the face plate, which would ordinarily be a metal stamping, and the cartridge clip, which connects to the return wire.

It should thus be clear how the mounting bracket 20 is attached to a stud and how the wiring box is adjustably mounted in the mounting bracket, and how incoming power wires are attached to the junction cartridge of the wiring box and provide available power at pairs of contact points implemented by the junction elements within the cartridge, the receptacle and switch modules being plugged into these contact pairs defined by the junction cartridge.

The details of construction of the switch and receptacle modules is described below, but generally speaking each is provided with a pair of rearwardly projecting prongs 72 which are plugged into the tunnel contacts behind the holes 58. Before this is done, however, it will be noted that each of these modules has upper and lower rearwardly bent clip elements 74 which cooperate with similar elements 76 projecting rearwardly from the face plate. As the modules slide toward the apertures 78, the curled ends 80 of the clips 74 slide along the side edges ofthe face plate clips 76 until spring members 82 snap into place in front of stops 84. The modules can be removed by inserting a knife or other bladed instrument between the clips 74 and 76 from the front.

Thus, assuming for the moment that as is depicted in FIG. 1 it is desirable to use at a particular site a receptacle outlet in conjunction with a switch, a receptacle module 26 would be clipped into the top portion of the face plate 30 and a switch module 28 would be clipped in the bottom portion. The face plate together with modules would then be inserted into the previously assembled wiring box described above so that the prongs 72 made proper contact with the junction cartridge. Wiring of the junction cartridge would of course proceed according to what function was installed. In the event these functions are changed and different modules are installed, the junction cartridge has a pair of bores 86 immediately above and below the respective side clips 60 of the junction elements through which a nail or other suitable object can be inserted to free the power wires from these clips and ready same for insertion of the wires in a different configuration.

The switch module 28 is illustrated in detail in FIGS. 4, 7, 8, 9 and 14. The module is attached to the rear of face plate as shown in FIG. 1 and as previously described. A pair of pins 88 (FIG. 1) are provided in the clips 76 by means of a retaining C spring 90, and these pins engage holes 92 which are provided in opposite sides of toggle cams 94. To facilitate achieving this engagement, the toggle cams are provided with ramps 96 as is shown only in FIG. 9. It can thus be seen from FIGS. 9 and 1 that it would be a simple matter to insert one of the toggle cams into an aperture 78 in the face plate such that the pins 88 snap into place in the holes 92 to retain the toggle therein.

Figure 4:
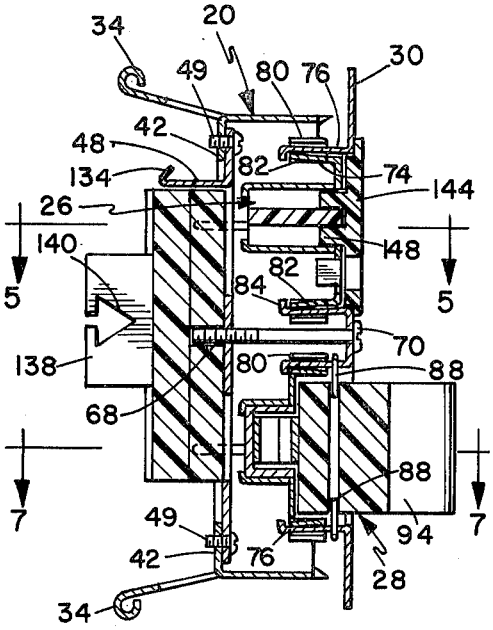
FIG. 4 is a sectional view taken on line 4—4 of FIG. 3.
Figure 5:
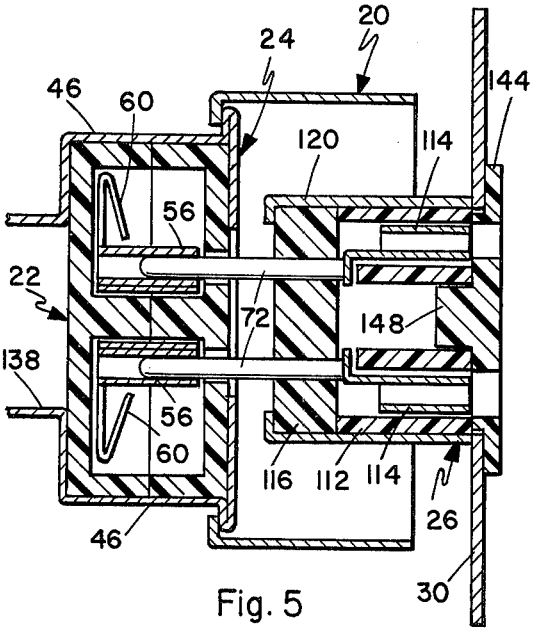
FIG. 5 is an enlarged sectional view taken on line 5—5 of FIG. 4.

The switching element itself is shown in FIG. 4 having a plastic casing 98 which is made in two parts which mate to encase in seated arrangement the two contact elements 100 and 102. An elbow 104 bent in 102 projects from the plastic casing 98, and as can be seen in FIG. 7, this elbow fits in a notch 106 in the toggle 94 so that when the toggle is in the position shown in solid in FIG. 7, the switch is in its closed position and when moved to the phantom position, the switch is thrown open.

Figure 7:
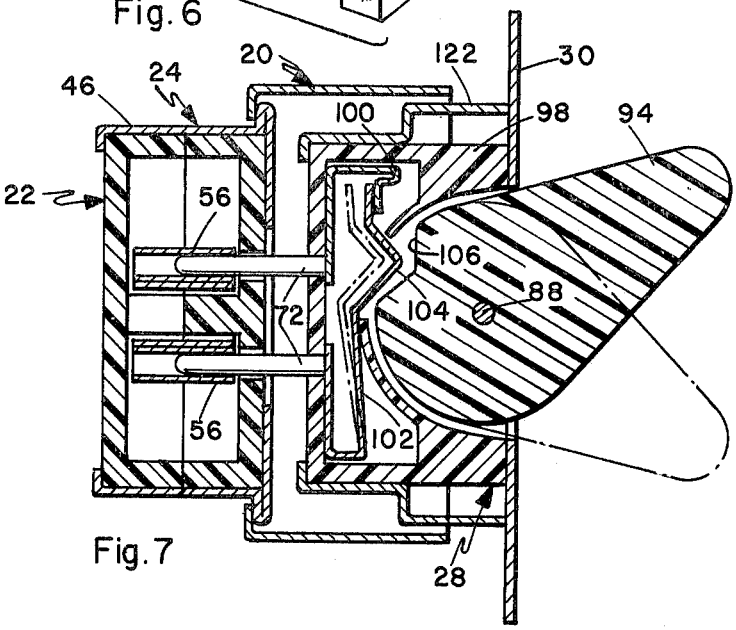
FIG. 7 is an enlarged sectional view taken on line 7—7 of FIG. 4.

It can be seen from FIG. 7 that because the elbow 104 and notch 106 are laterally eccentric rather than being provided centrally, what is the OFF position in FIG. 7 would be the ON position if the switch module were simply pulled out, turned upside down, and reinserted in the face plate. This would simply reverse the action of the toggle.

Figure 8:
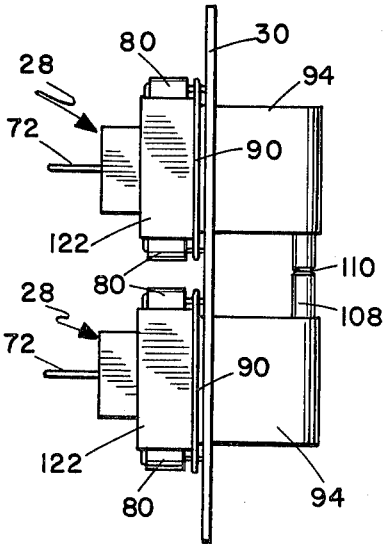
FIG. 8 is a side elevation view of a dual switch assembly.
Figure 9:
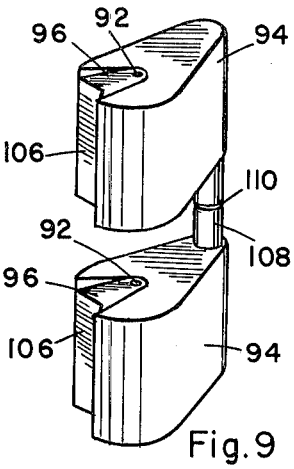
FIG. 9 is a perspective view of a dual switch actuator.
Figure 10:
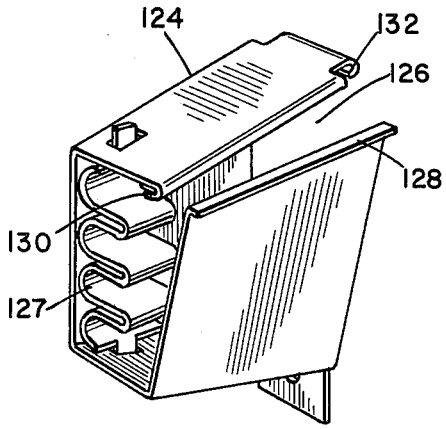
FIG. 10 is a perspective view of the wire clamp in open position.

Although it would not ordinarily make any difference whether or not the toggle action is reversed, the toggle is provided in pairs as shown in FIGS. 8 and 9 connected by means of a stem 108 which is annularly scored as at 110 for purposes of breaking into two separately operative toggles. However, when operated together, depending on how the switch modes are inserted, the double toggle arrangement will be set up to produce a double current switch, or a two way switch of the type where two physically separate switch stations control a single light or appliance.

Figure 12:
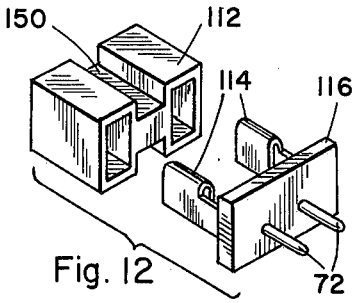
FIG. 12 is an exploded perspective view of one form of outlet unit.
Figure 13:
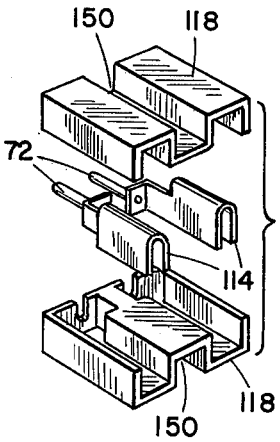
FIG. 13 is an exploded perspective view of an alternative outlet unit.
Figure 14:
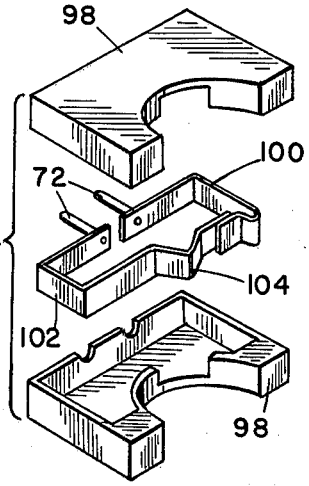
FIG. 14 is an exploded perspective view of the switch module.

The receptacle module as shown in two representative embodiments in FIGS. 12 and 13, 14 respectively. In FIG. 12, an insulator sleeve 112 is inserted over a pair of female spade terminals 114 mounted in an insulator backing 116. The same result is achieved in FIG. 13 except that the insulator is provided in a pair of half shells as shown at 118. In either case the resultant receptacle module constitutes an insulated casing housing a pair of bayonet terminal receptacles at one end and prongs at the other. This unit is in turn enclosed within a metal clip housing 120 which is best shown in FIG. 1. This housing is essentially a flat front plate which abuts the rear surface of the face plate with a rearwardly extended rectangular casing into which the receptacle sub-module of one of the types shown in FIGS. 12 or 13 is inserted from the front. A similar metal clip housing 122 is provided for the switch module.

Figure 11:
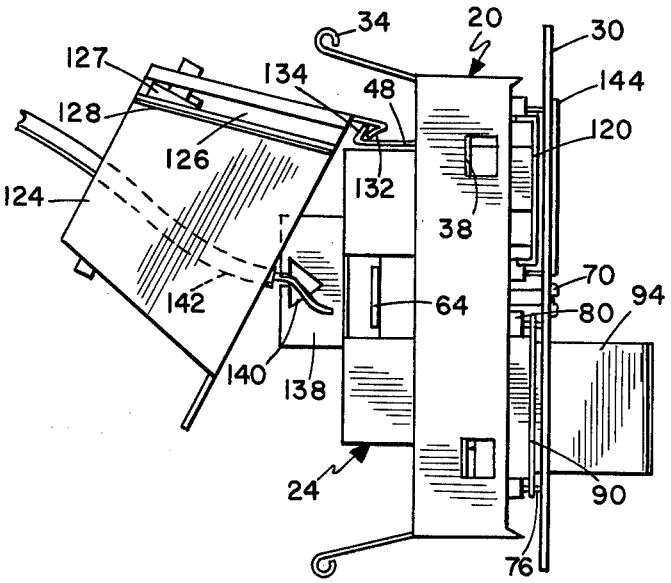
FIG. 11 is a side elevation view, similar to FIG. 2, showing the attachment of the wire clamp.

After the power wires have been inserted into the wiring box, a rear cable cover 124 is inserted over the bunch of attached wires, which can be done because of the split edge 126. Once the wires are inserted within the cable cover, they can be captured in the bays of the corrugated clamp 127 and the split edge 126 can be reconnected by engaging the lip 128 back in the curl 130. Then the forward curl 132 is engaged in hinge fashion with the upstruck flange 134 of the end stop 48 to provide the cover with a hinging action as shown in FIG. 11. The cover is then brought down and connected by means of a screw 136 to the junction cartridge clip 24.

Figure 2:
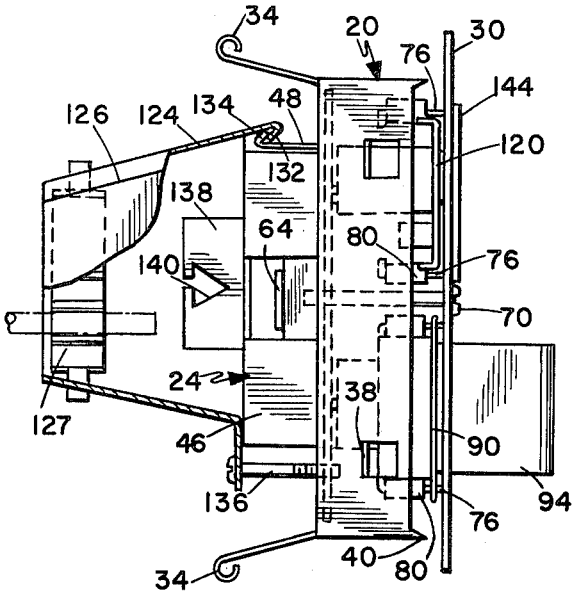
FIG. 2 is a side elevation view of an assembled switch and outlet unit.

It will be noted that the sides 46 which define the tracks for the junction cartridge have rearwardly projecting tabs 138, each of which has a split aperture 140. These tabs are positioned so that they are flush against the interior surface of the cable cover 124 when the latter is swung down into locked position. As can be seen in FIG. 11, a ground wire 142 is engaged through the split aperture 140 and is loosely retained therein until the cable cover is brought down into closed position as shown in FIG. 2. When this occurs the stripped end of the ground wire is clamped between the tab 138 and the cable cover for a secure grounding connection which does not require a separate connector or connecting motion.

A receptacle cover 144 is utilized in the face plates over an aperture in which a receptacle is mounted. This cover has top and bottom holes 146 which are clipped by the retaining pins 88 in a fashion similar to the toggle cams 94. The cover has rearwardly projecting studs 148 which engage in the channels 150 provided in a top and bottom of these receptacle modules as seen in FIGS. 12 and 13, the actual engagement being shown in FIG. 4.

Figure 15:
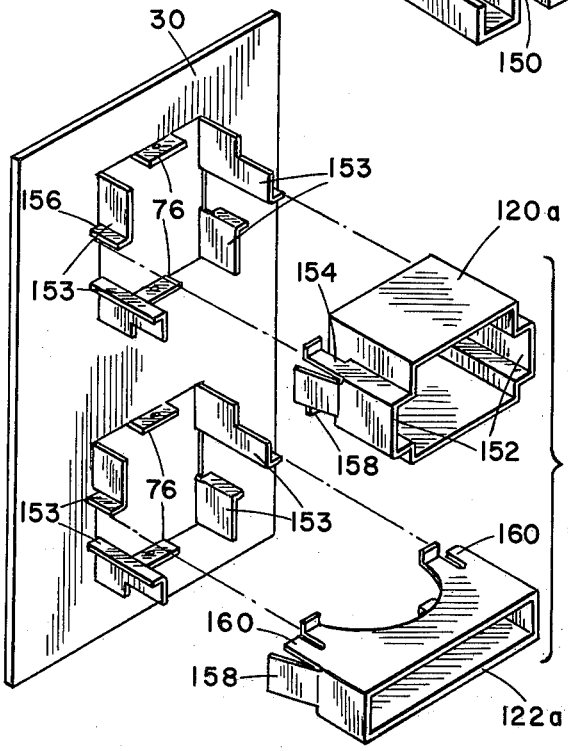
FIG. 15 is an exploded perspective view of an alternative face plate and module housings.

FIG. 15 illustrates a slight modification of the face plate and the metal clip housings for the receptacle module and switch module. In this embodiment the metal clip housings for the outlet module 26 and the switch module 28 are indicated at 120 *a* and 122 *a*, respectively. These clip housings snap in by virtue of side columns 152 which are guided by appropriate track-forming members 153 projecting rearwardly from the face plate. Upper tab members 154 engage and snap into place in front of flanges 156 while leaf spring 158 creates a rearward tension on these housings so that the mounting is secure. A metal stud 160 may be provided as an housing for the switch module to buttress against the rear of the face plate for additional strength.

As shown and described the combination switchoutlet receptacle is cheap per unit to manufacture, utilizing only thin sheet metal and plastic. Initial manufacturing set-up cost is minimized by the versatility provided by the exchangeable and selectable nature of the switch and receptacle modules. As has been described above, simplicity of changing the arrangement after it has been initially installed is also inherent in the design. In addition, the savings of volume occupancy compared to conventional wiring and outlet boxes runs as high as two-thirds to four-fifths.

I claim:

1. A modular electrical switch/outlet assembly comprising:

(a) a wiring box having connections for incoming power wires and having a plurality of spaced contact pairs coupled to said connections;

(b) mounting means for said wiring box to mount same to a building member;

(c) at least one switch module having contacts dimensioned and positioned to mate alternatively with any of said contact pairs;

(d) at least one receptacle module having contacts positioned and dimensioned to mate alternatively with any of said contact pairs, whereby said assembly can provide a plurality of different switch and receptacle combination;

(e) a face plate having a plurality of openings and each of said openings having mounting means to alternatively engage a selected one of a plurality of said modules in any desired combination; and (f) said mounting means for said modules being brackets extending rearwardly from said face plate and which cooperate with complimentary means on said modules such that the latter make a snap-on connection with said module mounting brackets.

2. Structure according to claim 1 wherein said brackets each include a pair of spring-loaded retainer pins on the opposite side of the respective openings in said face plate, and including a toggle element inserted through the front of said face plate and journalled on said retainer pins to operate a switch mounted to the rear of the respective opening.

3. Structure according to claim 2 and including a cap having recesses engageable by said retainer pins to cap an opening having a receptacle module mounted therebehind.

4. A modular electrical switch/outlet assembly comprising:

(a) a wiring box having connections for incoming power wires and having a plurality of spaced contact pairs coupled to said connections;

(b) mounting means for said wiring box to mount same to a building member;

(c) at least one switch module having contacts dimensioned and positioned to mate alternatively with any of said contact pairs;

(d) at least one receptacle module having contacts positioned and dimensioned to mate alternatively with any of said contact pairs, whereby said assembly can provide a plurality of different switch and receptacle combinations; and (e) said switch module having a laterally eccentrically disposed operative contact tab and is toggle cam operated, and including a toggle cam to operate same, said toggle cam having an eccentric portion operable to operate said tab whereby reversal of said switch module around the longitudinal axis thereof to reverse the direction of eccentricity of said tab reverses the effect of operating said toggle cam.

5. Structure according to claim 4 wherein said at least one switch module is plurality provided and including a face plate having a plurality of aligned access openings therein and including means to mount a switch module behind each of said openings, said switch modules being toggle operated and including a plurality of toggle cams journalled in respective ones of said openings to operate said switch modules and including a stem connecting said toggle cams for concomitant operation.

6. Structure according to claim 5 wherein said stem is frangible between cams by virtue of weakened portions incorporated therein.

7. A modular electrical switch/outlet assembly comprising:

(a) a wiring box having connections for incoming power wires and having a plurality of spaced contact pairs coupled to said connections;

(b) mounting means for said wiring box to mount same to a building member;

(c) at least one switch module having contacts dimensioned and positioned to mate alternatively with any of said contact pairs;

(d) at least one receptacle module having contacts positioned and dimensioned to mate alternatively with any of said contact pairs, whereby said assembly can provide a plurality of different switch and receptacle combination; and (e) a rear cable cover being resilient and open along one edge to permit the insertion of cables therethrough, whereby cables can be covered subsequently to their attachment to said wiring box.

8. Structure according to claim 7 wherein said wiring box includes a pair of rearwardly directed flanges to guide said rear cable cover into seated position, at least one of said flanges having an opening therethrough for the insertion of a ground wire, whereby attachment and seating of said rear cable cover will shear across said one flange to securely capture said ground wire.

9. Structure according to claim 7 wherein said rear cable cover is hinged at one edge to said wiring box and swings into operative position covering the rear of said wiring box and the stripped ends of power wires attached thereto.

10. A modular electrical switch/outlet assembly comprising:

(a) a wiring box having connections for incoming power wires and having a plurality of spaced contact pairs coupled to said connections;

(b) mounting means for said wiring box to mount same to a building member;

(c) at least one switch module having contacts dimensioned and positioned to mate alternatively with any of said contact pairs;

(d) at least one receptacle module having contacts positioned and dimensioned to mate alternatively with any of said contact pairs, whereby said assembly can provide a plurality of different switch and receptacle combinations; and (e) said wiring box including a pair of electrically isolated junction elements connecting the respective contacts of the contact pairs to the separate contacts of other contact pairs, said junction elements having frangible portions between contact pairs such that when said portions are broken the contact of adjacent contact pairs are electrically isolated.

11. Structure according to claim 10 wherein said junction elements are contained within an insulator cartridge and said frangible portions project externally of said cartridge.

12. Structure according to claim 11 wherein said insulated cartridge and junction elements together comprise a junction cartridge constituting two mating halves seating said junction contacts therebetween, and said junction elements provide tubular metal sleeves aligned with openings in one of said mating halves to constitute and contact pairs.

* * * * *